United States Patent [19]

Lobbe et al.

[11] 4,159,850

[45] Jul. 3, 1979

[54] MINERAL MINING INSTALLATION WITH FACE END WINNING

[75] Inventors: Armin Lobbe, Oberaden; Bernd Steinkuhl, Lunen, both of Fed. Rep. of Germany

[73] Assignee: Gewerkschaft Eisenhutte Westfalia, Fed. Rep. of Germany

[21] Appl. No.: 874,675

[22] Filed: Feb. 2, 1978

[30] Foreign Application Priority Data

Feb. 5, 1977 [DE] Fed. Rep. of Germany ..... 2704809

[51] Int. Cl.[2] ..... E21C 27/35

[52] U.S. Cl. ..... 299/34

[58] Field of Search ..... 299/32, 34

[56] References Cited

U.S. PATENT DOCUMENTS 3,488,094 1/1970 Ostrop et al. ..... 299/34

3,785,704 1/1974 Ostrop et al. ..... 299/34

FOREIGN PATENT DOCUMENTS 1533798 3/1970 Fed. Rep. of Germany ..... 299/34

*Primary Examiner*—Ernest R. Purser

*Attorney, Agent, or Firm*—Sughrue, Rothwell, Mion, Zinn and Macpeak

[57] ABSTRACT

A mineral mining installation has a longwall conveyor provided with a guide at the face-side thereof. A drive frame is provided at each end of the conveyor, and a plough is movable along the guide to win material from the longwall face. The plough is driven by a chain passing round a pair of end sprockets associated with the drive frames. The plough is constituted by a pair of plough bodies joined together by an intermediate member pivotally connected therebetween. Each of the plough bodies is provided with cutter bits and the intermediate member may also have cutter bits. The two ends of the plough driving chain are connected to the intermediate member, and the plough is of sufficient length to enable material to be won at least as far as each end sprocket.

10 Claims, 3 Drawing Figures

MINERAL MINING INSTALLATION WITH FACE END WINNING

BACKGROUND OF THE INVENTION

This invention relates to a plough for winning material in a longwall working, and to a mineral mining installation incorporating such a plough.

A conventional mineral mining installation consists of a scraper chain conveyor positioned alongside a longwall face, and a plough driven along a guide at the face-side of the conveyor by an "endless" chain. The chain is accommodated in guide channels defined within the guide, and passes over sprockets mounted on the drive frames at the two ends of the conveyor. At least one of these plough driven chain end sprockets is provided with a drive unit.

The disadvantage of this conventional installation is that it is not possible for the plough to mine material from the entire length of a longwall face. It is necessary, therefore, to mine material from the longwall face ends (the so-called "stable-holes") either manually or by means of special stable-hole ploughs, which considerably increase the cost of the installation. These stable-holes actually need to be cut away to a greater depth than that by which the face itself is worked, in order to accommodate the heavy and bulky drive units for the main plough and the conveyor.

Another known type of mineral mining installation utilises a conveyor whose ends curve through 90°, so that stable-holes (or galleries) can be formed at the longwall face ends by the main plough. Unfortunately, this installation requires additional heavy machinery. Another disadvantage is that the stable-hole tends to become crammed by the extended plough and conveyor sections. Moreover, the necessary deflection of the conveyor and plough chains in the curved regions develops high chain traction forces which results in a substantial increased wear of chains and guide devices.

The aim of the invention is to provide a mineral mining installation for winning material in a longwall working which enables the entire length of the longwall to be mined by a single plough and without the need for additional plant or expense to win material in the stable-hole regions.

SUMMARY OF THE INVENTION

The present invention provides a plough for winning material in a longwall working having no stable-hole, the plough being formed with guide surfaces which, in use, co-operate with a guide provided in the longwall working, and the plough being drivable by means of a chain passing round a pair of end sprockets, wherein the plough is constituted by two longitudinally spaced plough bodies each of which is provided with cutter means, the two plough bodies being connected together by means of an intermediate member pivotally connected to each of the plough bodies, the intermediate member being provided with attachment means for connection to the two ends of the plough driving chain, and the plough being of sufficient length to enable material to be won at least as far as each end sprocket.

Advantageously, the intermediate member is provided with cutter means, and said guide surfaces are formed on the intermediate member and on the plough bodies.

The invention also provides a mineral mining installation for winning material in a longwall working, the installation comprising a conveyor, a guide provided at the face-side of the conveyor, a drive frame at each end 1 in a longwall working, the installation comprising a conveyor, a guide provided at the face-side of the conveyor, a drive frame at each end of the conveyor, a plough movable along the guide, and a plough driving chain passing round a pair of end sprockets, each end sprocket being associated with a respective one of the drive frames, wherein the plough is as defined above.

The guide may define a pair of guide channels for the two runs of the plough driving chain. In this case, the intermediate member is preferably provided with a pair of flanges which extend into one of said guide channels to assist with the guiding of the plough. Advantageously, each of the two flanges is provided with attachment means for connection to a respective end of the plough driving chain.

Preferably, each end sprocket is positioned beyond the free end of its associated drive frame, and one of the end sprockets is associated with a drive unit for driving the plough driving chain. In this case, the plough drive unit may be pivotally mounted to the free end of the associated drive frame.

Advantageously, the guide is off-set away from the conveyor, and towards the longwall face, in the region of each of the drive frames whereby a gap is formed between each drive frame and the adjacent portion of the guide, each of said gaps constituting an access area for the plough driving chain to pass between the associated end sprocket and the guide channels. Preferably, each off-set portion of the guide extends longitudinally beyond its associated end sprocket.

BRIEF DESCRIPTION OF THE DRAWINGS

A mining installation incorporating one form of plough constructed in accordance with the invention will now be described, by way of example, with reference to the accompanying drawings, in which.

DESCRIPTION OF PREFERRED EMBODIMENT

Figures 1, 2, 3:
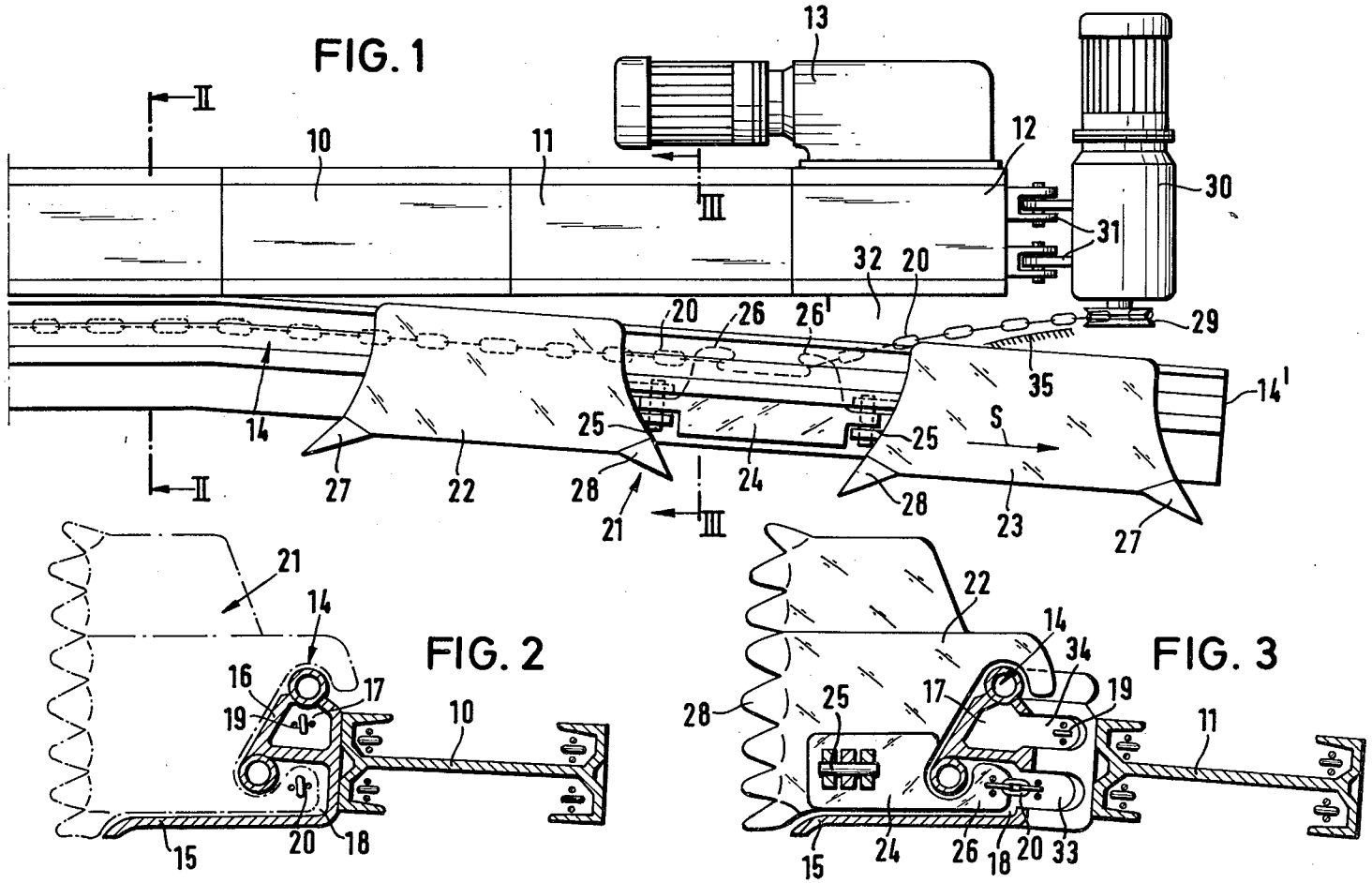
FIG. 1 is a plan view of the mining installation.
FIG. 2 is a cross-section taken on the line II—II of FIG. 1.
FIG. 3 is a cross-section taken on the line III—III of FIG. 1.

Referring to the drawings, FIG. 1 shows a scraper chain conveyor 10 positioned adjacent to a longwall face (not shown) of a mine working. The scraper chain conveyor consists of a plurality of individual channel sections joined end-to-end. The channel sections are pivotally connected to one another in such a manner as to permit limited relative movement in any direction. A drive frame 12 is provided at the end of the conveyor 10, the drive frame being joined to the conveyor by means of a connector 11. The drive frame 12 locates a drum (not shown) for driving the chain or chains of the conveyor 10. An auxiliary drive unit 13 is mounted on the goaf-side side plate of the drive frame for driving the drum. The other end of the conveyor 10 is similarly provided with a drive frame 12, a connector 11 and a chain drum, but in this case the drive frame is provided with a main drive unit.

FIG. 1 shows a plough 21 in the region of the auxiliary drive head, that side of the conveyor 10 adjacent to the longwall face being provided with a guide 14 for the plough. The guide 14 is formed in sections corresponding to the channel sections of the conveyor 10, and each guide section is constituted by a floor plate 15 and an inclined ramp plate 16. The ramp plates 16 define a pair of channels 17 and 18 which house the two runs 19 and 20 of an endless chain for driving the plough 21. The channels 17 and 18 are arranged one above the other, with the upper channel housing the return run 19 of the chain, and the lower channel housing the traction run 20. The floor plates 15 define a bottom support along which the plough 21 can slide.

The plough 21 is constituted by two plough bodies 22 and 23 connected together by an intermediate member 24, the intermediate member being pivotally connected to each of the plough bodies by means of pivot pins 25 which are substantially horizontal and substantially normal to the longwall face. This articulation ensures that the relatively long plough 21 can adapt itself to irregularities in the floor of the mine working. The intermediate member 24 thus interconnects the two plough bodies in a tension-proof manner, that is to say so as to withstand the normal pressures and tensions arising during the working of the plough 21. The intermediate member 24 is guided along the guide 14 by means of brackets or flanges 26 and 26' which also serve as the connection points for the two ends of the plough drive chain traction run 20. In this way, the plough chain 19,20 is connected to the plough 21 at points positioned approximately midway along its length.

Each plough body 22 and 23 is provided with a plurality of cutter bits 27 which point away from the intermediate member 24, and a plurality of cutter bits 28. The cutter bits 28 of the two bodies 22 and 23 point towards each other and the cutter bits 27 and 28 of the body 22 are staggered in the vertical direction relative to the corresponding cutter bits on the plough body 23.

The plough chain 19,20 is driven from the auxiliary drive end of the conveyor 10 by means of a sprocket 29 and a drive unit 30. The drive unit 30 is pivotally mounted on the end face of the drive frame 12 by pivot joints 31 so that the sprocket 29 is positioned beyond the end of the drive frame.

At the end of the conveyor 10, the plough guide 14 is off-set slightly towards the longwall face so as to leave a gap 32 between the drive frame 12 and the portion of the guide immediately adjacent thereto. The sprocket 29 is aligned with this gap 32 which thus serves as a passage for accommodating the plough chain 19,20. Cut-outs 33 and 34 are formed in the goaf-side of the off-set portion of the guide 14, these cut-outs being provided for the passage of the chain runs 19 and 20 from the sprocket 29 to the respective channels 17 and 18. In order to guide the chain 19,20 smoothly into and out of these cut-outs 33 and 34, special chain guide plates 35 are provided at the mouth of the gap 32.

It will be apparent from FIG. 1 that, owing to the substantially central connection between the plough 21 and its drive chain and owing to the length of the plough, the cutter bits 27 at the front of the plough (that is to say the cutter bits 27 of the plough body 23 if the plough is travelling in the direction S) can win coal much further along the longwall face than is possible with known ploughs. FIG. 1 actually shows the approximate end position of the plough 21, at which the cutter bits 27 of the plough body 23 win coal right up to the end of the longwall face and into the roadway or gallery formed at that end. In particular, it should be noted that the longwall face can be mined to a point beyond the end of the drive frame 12 and also beyond the sprocket 29 of the plough drive unit 30.

During its travel in the direction S, the cutters 28 of the trailing plough body 22 also win coal, owing to their staggered positions relative to the cutters 27 of the plough body 23. Similarly, when the plough 21 moves in the opposite direction, the cutter bits 27 of the plough body 22 and the cutter bits 28 of the plough body 23 both win coal. It would also be possible to provide the intermediate member 24 with cutter bits.

Obviously, the plough 21 could also be used where it is not possible for the plough to reach the end of the longwall face or where the coal in the area at the end of a longwall face was mined during excavation of a roadway or gallery. What is important, however, in such cases is that the plough 21 can reach the drive frame 12 and preferably the sprocket 29.

We claim:

1. In a mineral mining installation for winning material in a longwall working, the installation comprising a conveyor, a guide provided at the face-side of the conveyor, a drive frame at each end of the conveyor, a plough movable along the guide, and a plough driving chain passing around a pair of end sprockets, each end sprocket being associated with a respective one of the drive frames, the improvement comprising constituting the plough by two longitudinally spaced plough bodies each of which is provided with cutter means, the two plough bodies being connected together by means of an intermediate member pivotally connected to each of the plough bodies, the intermediate member being connected to the two ends of the plough driving chain, and the plough being of sufficient length to enable material to be won at least as far as each end sprocket, wherein the guide defines a pair of guide channels for the two runs of the plough driving chain, and wherein the guide is off-set away from the conveyor, and towards the longwall face, in the region of each of the drive frames whereby a gap is formed between each drive frame and the adjacent portion of the guide, each of said gaps constituting an access area for the plough driving chain to pass between the associated end sprocket and the guide channels.

2. A plough according to claim 1, wherein the intermediate member is provided with cutter means.

3. A plough according to claim 1, wherein guide surfaces are formed on the intermediate member and on the plough bodies, said guide surfaces co-operating with the guide.

4. A mineral mining installation for winning material in a longwall working, the installation comprising a conveyor, a guide provided at the face-side of the conveyor, a drive frame at each end of the conveyor, a plough movable along the guide, and a plough driving chain passing around a pair of end sprockets, each end sprocket being associated with a respective one of the drive frames, wherein the plough is constituted by two longitudinally spaced plough bodies each of which is provided with cutter means, the two plough bodies being connected together by means of an intermediate member pivotally connected to each of the plough bodies, the intermediate member being connected to the two ends of the plough driving chain, and the plough being of sufficient length to enable material to be won at least as far as each end sprocket, wherein the guide defines a pair of guide channels for the two runs of the plough driving chain, and wherein the guide is off-set away from the conveyor, and towards the longwall face, in the region of each of the drive frames whereby a gap is formed between each drive frame and the adjacent portion of the guide, each of said gaps constituting an access area for the plough driving chain to pass between the associated end sprocket and the guide channels.

5. A mineral mining installation according to claim 4, wherein the intermediate member is provided with a pair of flanges which extend into one of said guide channels to assist with the guiding of the plough.

6. A mineral mining installation according to claim 5, wherein each of the two flanges is provided with attachment means for connection to a respective end of the plough driving chain.

7. A mineral mining installation according to claim 4, wherein each end sprocket is positioned beyond the free end of its associated drive frame.

8. A mineral mining installation according to claim 7, wherein one of the end sprockets is associated with a drive unit for driving the plough driving chain.

9. A mineral mining installation according to claim 8, wherein the plough drive unit is pivotally mounted to the free end of the associated drive frame.

10. A mineral mining installation according to claim 4, wherein each off-set portion of the guide extends longitudinally beyond its associated end sprocket.

* * * * *